United States Patent [19]

Mayer et al.

[11] 4,148,707

[45] Apr. 10, 1979

[54] ELECTROCHEMICAL FINISHING OF STAINLESS STEEL

[75] Inventors: Peter Mayer, Burlington; Robert W. Blair, Perth; Mohammed Zamin, Mississauga, all of Canada

[73] Assignee: Heritage Silversmiths Limited, Perth, Canada

[21] Appl. No.: 925,769

[22] Filed: Jul. 18, 1978

Related U.S. Application Data

[62] Division of Ser. No. 814,271, Jul. 8, 1977, Pat. No. 4,118,301.

[51] Int. Cl.[2] ..... C25F 7/00; C25F 3/00; C25D 17/08

[52] U.S. Cl. ..... 204/297 W

[58] Field of Search ..... 204/297 W, 297 R, 297 M, 204/242, 129.1, DIG. 7

[56] References Cited

U.S. PATENT DOCUMENTS

| | | | |
|---|---|---|---|
| 2,505,212 | 4/1950 | Schneider | 204/297 W X |
| 2,532,516 | 12/1950 | Schneider | 204/297 W |
| 3,314,877 | 4/1967 | Novitsky | 204/297 W |
| 3,462,357 | 8/1969 | Karlquist | 204/297 W |

FOREIGN PATENT DOCUMENTS

| | | | |
|---|---|---|---|
| 1057148 | 2/1967 | United Kingdom | 204/297 W |

*Primary Examiner*—F.C. Edmundson
*Attorney, Agent, or Firm*—Sim & McBurney

[57] ABSTRACT

The electrofinishing of stainless steel items, especially cutlery items, to a substantially corrosion resistant mirror finish is achieved in two steps, the first step involving electropolishing and the second step passivation of the electropolished surface. Apparatus for effecting the electrofinishing operation is also described.

8 Claims, 9 Drawing Figures

FIG. 4.
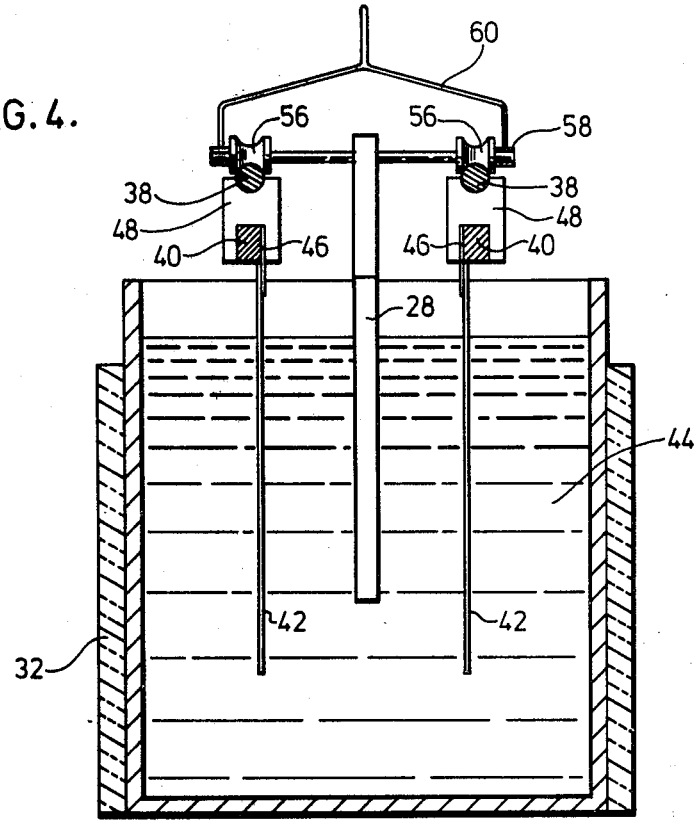
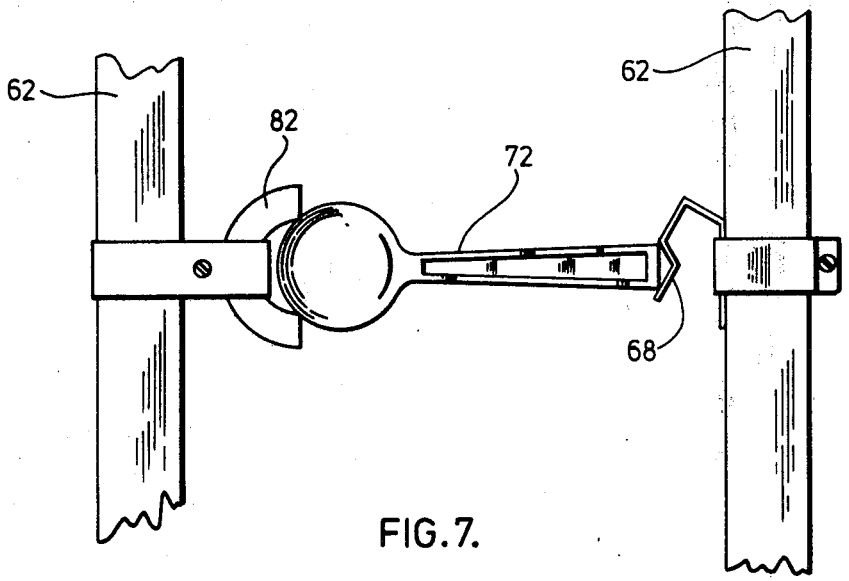
FIG. 7.

METAL REMOVAL RATE (μm/min)
20
18
16
14
12
10
8
70
80
90
TEMP °C
10v.
8v.
6v.

METAL REMOVED (mg/cm²)
50
40
30
20
10
0
0.5
1.0
1.5
2.0
2.5
3.0
3.5
TIME (MINS)
10v.
8v.
6v.

ELECTROCHEMICAL FINISHING OF STAINLESS STEEL

This is a division of application Ser. No. 814,271 filed July 8, 1977; now U.S. Pat. No. 4,118,301.

FIELD OF INVENTION

This invention relates to the electrochemical finishing of stainless steel items.

BACKGROUND TO THE INVENTION

In the manufacture of stainless steel cutlery items, such as knives, forks and spoons, the desired shape, which may be patterned, first is punched or die cut from a stainless steel sheet, and the resulting item is ground, polished and buffed to remove sharp edges and provide a finish of desired lustre (reflectivity).

The grinding, polishing and buffing operations are carried out by hand, and thus are time consuming, tedious and labour intensive. As a direct result, the market place is dominated by stainless steel cutlery products manufactured in oriental countries where there is an abundance of cheap labour.

SUMMARY OF INVENTION

The present invention is directed to a two stage operation which provides a substantially corrosion resistant mirror-like finish on the surface of stainless steel items, particularly cutlery items, such as, knives, forks and spoons, but including other tableware, such as teapots, milk jugs, sugar bowls and gravy boats. The first stage involves electropolishing of the rough-cut or part-finished item and the second stage involves passivation of the electropolished surface.

The present invention allows multiple members of items to be treated simultaneously and the operation is susceptible of continuous or semi-continuous operation with a minimum of manual operation. The production of the finished item using this invention is significantly faster than the conventional hand operations.

The electrolytic treatment of the rough stamped or partially finished item eliminates the need for the hand grinding, polishing and buffing operations of the prior art, thereby decreasing substantially the cost of manufacture and allowing the production of polished stainless steel items at competitive prices in high labour cost countries.

Hand finished mirror-like finish stainless steel items are not highly corrosion resistant or resistant to bacteria, especially when made from magnetic stainless steel, and hence the mirror finish tends to lose its lustre with time. The passivation step used in this invention results in a substantially corrosion and bacteria-resistant mirror-like finish, on both magnetic stainless steels and non-magnetic stainless steels, which does not lose its lustre over an extended period of time, thereby providing a further advantage over the hand finished items.

GENERAL DESCRIPTION OF INVENTION

The degree of lustre of the finish on the treated stainless steel item may be determined by the surface roughness, as determined by ASA Standard B-46.1-1955. A mirror-like finish has a surface roughness of less than 2 microinches (0.05 microns), while satin and fine buff finishes have a surface roughness of less than 8 microinches (0.2 microns). The latter finishes are further defined in British Standard 4038 (1966). The present invention is particularly concerned with the provision of a smooth mirror-like finish on stainless steel items, since this is the finish most usually required on such items.

While the present invention will be described with particular reference to stainless steel cutlery items, as already indicated the invention has broader application to other stainless steel items. Similarly, while the invention is particularly described with respect to the treatment of items constructed of magnetic stainless steel (i.e., 400 Series stainless steel) since this stainless steel is the one most commonly used for cutlery items, the invention is also applicable to the treatment of items constructed of non-magnetic stainless steel (i.e., 300 Series stainless steel).

The principles of electrochemical finishing are known and do not require extensive review. An item to be electrochemically finished is immersed in an electrolyte and is made the positive electrode. Upon the passage of an electric current through the electrolyte, metal is dissolved from the anode surface, with protrusions being dissolved faster than depressions, thereby producing a smoothening of the surface.

These principles have not heretofore been applied to the mass production of magnetic and non-magnetic stainless steel cutlery items having a mirror-like finish and the prior art provides no guide to the parameters which must be used in the production of corrosion-resistant mirror-like surfaces on stainless steel items.

The first step which is involved in the process of the invention is the electropolishing of the stainless steel item to a mirror-like finish. It has been found that several critical parameters must be adhered to if the desired mirror-like finish is to be produced, including parameters of the electrolyte bath and the electrochemical conditions.

The electrolytic bath used in the present invention is one containing orthophosphoric acid and sulphuric acid along with suitable inhibitors to prevent etching of the stainless steel item by the acid bath and enable polishing to be achieved. Generally, the electrolyte bath used contains about 55 to about 75% by weight of the acids, about 5 to about 15% by weight water and the remainder by weight of one or more inhibitors.

A particularly useful bath composition utilizable in the process of the invention utilizes hydroxyacetic acid and a mixture of aryl sulfonic acids, typically benzene sulfonic acid and toluene sulfonic acid, as the inhibitor material.

Such compositions preferably contain about 55 to about 75% by weight of the mixture of acids in the weight proportions of orthophosphoric acid to sulphuric acid of about 1:1 to about 2:1, about 10 to about 20% by weight of hydroxyacetic acid, about 5 to about 35% by weight of the aryl sulfonic acids, and about 5 to about 15% by weight of water.

A suitable commercially-available metal electrolytic treatment bath of this type is known as "Electro-Gleam 55." While this bath may be used as is for the electrochemical deburring of magnetic stainless steel cutlery items, a mirror-like finish cannot be obtained.

To obtain the mirror-like finish, the electrolytic bath is required to have a specific gravity, determined at a temperature of about 85° C., which is within a certain range which is determined by the dissolved concentration of iron in the solution, with the lower and upper limits of the range increasing with increasing dissolved iron concentration, as outlined in more detail below.

Generally, the specific gravity is in the range of about 1.6 to about 1.8, preferably about 1.7 to about 1.8.

A minimum dissolved iron concentration in the electrolyte bath is required to achieve satisfactory electropolishing of magnetic and non-magnetic stainless steels. The dissolved iron concentration is at least about 0.5% by weight for magnetic stainless steels and at least about 1% by weight for non-magnetic stainless steels. Iron is dissolved from the stainless steel items as they are polished and tends to build up in the electrolytic bath and provide the required specific gravity, although the specific gravity may be varied, as desired, by dilution with water or concentration by evaporation. The dissolved iron concentration builds up in the bath until its solubility limit is reached, after which additional iron precipitates in salt form. Other metals dissolved from the stainless steel item, i.e., chromium and nickel, readily sludge out of the system as insoluble salts during the electrochemical treatment.

By experimentation, general and optimum ranges of specific gravity of the electrolyte bath for varying iron concentration ranges have been arrived at, as follows:

| Iron Concentration wt. % | Specific gravity determined at 85° C. | | | |
|---|---|---|---|---|
| | Magnetic Stainless Steel | | Non-Magnetic Stainless Steel | |
| | General Range | Optimum Range | General Range | Optimum Range |
| 0.5 | 1.63 to 1.67 | — | — | — |
| 1 | 1.65 to 1.73 | 1.67 to 1.73 | 1.65 to 1.73 | 9.67 to 1.73 |
| 3 | 1.66 to 1.76 | 1.71 to 1.76 | 1.66 to 1.76 | 1.71 to 1.76 |
| 4 | 1.68 to 1.77 | 1.71 to 1.77 | 1.68 to 1.77 | 1.71 to 1.77 |
| 5 | 1.73 to 1.78 | 1.73 to 1.78 | 1.73 to 1.78 | 1.73 to 1.78 |

The ranges recited are interrelated with the operating parameters of the electrochemical treatment, as outlined in detail below, to achieve the required electropolishing. The current efficiency of the electrochemical process has been found to be substantially constant over the range of dissolved iron concentration.

The electrochemical treatment is required to be carried out by immersing the item, or a series of such items, in the treatment bath as the intended anode to no greater than the depth below which the hydrostatic pressure on the item in the bath is about 1.2 psi (85 g/sq.cm) determined at 85° C., which corresponds to a depth of about 18 inches (46 cm) in a typical electropolishing bath having a specific gravity determined at 85° C. of about 1.8. When the hydrostatic pressure exceeds this value then electropolishing is no longer possible.

The operating parameters of the electrochemical treatment are also important to the obtaining of the desired result. The following ranges of operating parameters have been found satisfactory for the formation of electrochemically finished cutlery items having a high lustre within the dissolved iron and specific gravity ranges outlined above:

| | General Range | Optimum Conditions |
|---|---|---|
| Voltage | about 6 to about 15 volts | about 8 to 10 volts |
| Current Density | about 2 to about 9 amp/sq.in (about 0.3 to about 1.4 amp/sq.cm) | about 6 amp/sq.in (about 1 amp/sq.cm) |
| Bath Temperature | about 70° to about 100° C. | about 85° to about 92° C. |

Over these ranges of values, some interrelation has been observed, in that, under otherwise fixed conditions, higher voltages result in a smoother surface finish, and higher temperatures lead to an improved surface lustre.

The time required to achieve the desired brightening is quite short. The overall bath treatment time usually depends on the degree of deburring required to provide an overall smoothness to the product. Items having pre-smoothed edges, or otherwise requiring only a minor degree of deburring to be performed, need only a short treatment time to achieve the overall desired result while rough stamped items having a high deburring requirement require a longer treatment time.

The longer the treatment time the more metal is removed from the surface and additional treatment beyond that required to achieve the desired finish does not confer any added benefit and indeed may be detrimental to delicate patterns or the like provided on the item.

Usually, the treatment time is less than about 15 minutes and typically about 6 to 8 minutes where deburring and electropolishing are required. Shorter times may be used, typically about 3 to 5 minutes, where the deburring requirement is low.

During the operation of the electropolishing step, it has been found that agitation of the bath is not required, although may be practised, if desired.

The second step involved in the process of the invention is passivation of the electropolished surface. Residual anions of the acid used in the electropolishing, such as, sulphate and phosphate ions, remain in contact with the mirror-like surface, even though the items are rinsed to remove residual electrolyte when removed from the electrochemical treatment bath.

The presence of such surface anions leads to fogging and loss of lustre when contacted with calcium and magnesium ions commonly found in water. The purpose of the passivation step in this invention, therefore, is to remove or otherwise render inactive the residual anions and form a protective corrosion resistant strongly adherent transparent chromium oxide film on the mirror-like surface.

The passivation treatment is carried out in the second step of the process of the invention by immersing the electropolished item in an aqueous nitric acid solution having a concentration of about 20 to about 40 vol.% at a temperature of about 45° to about 70° C. for at least about 20, usually up to about 60 minutes. Particularly preferred conditions for the passivation treatment involve use of a nitric acid solution containing about 25 vol.% $HNO_3$ at a temperature of about 65° to 70° C. for about 30 minutes.

BRIEF DESCRIPTION OF DRAWINGS

FIG. 4 is a sectional view taken on line 4—4 of FIG. 3;

FIG. 7 is an elevational view of an alternative racking arrangement; and

DESCRIPTION OF PREFERRED EMBODIMENT

Figure 1:
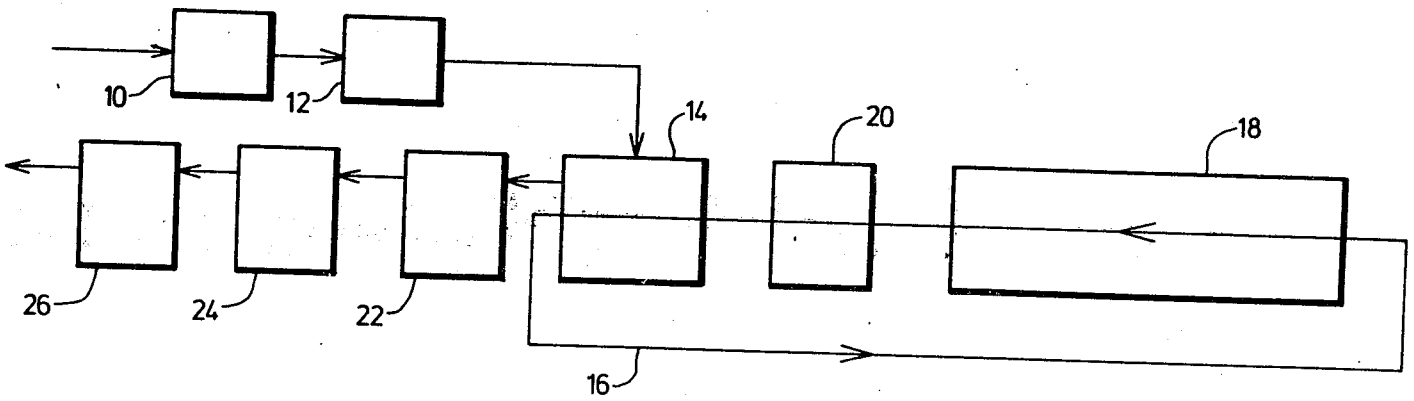
FIG. 1 is a plan view of an electrofinishing plant for carrying out the present invention.
Figure 2:
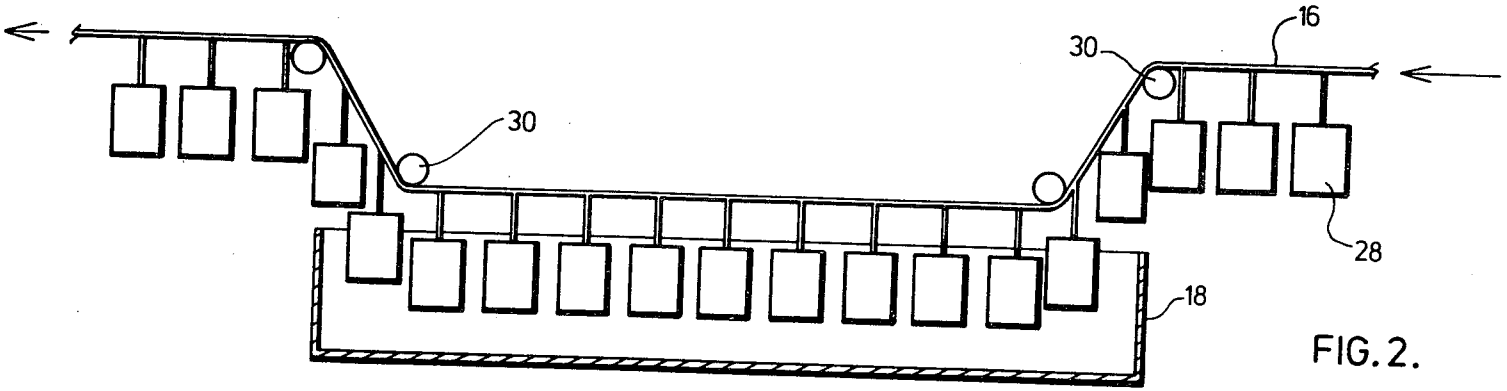
FIG. 2 is a schematic elevational view of a portion of the apparatus of FIG. 1 illustrating entry into and exit from an electropolishing tank or racks of cutlery items to be electropolished.

Referring first to FIGS. 1 to 5 of the drawing, there is illustrated an electrofinishing plant for effecting the process of the present invention. FIG. 1 illustrates the plant layout and the operation of the process will be described first with reference thereto. Stainless steel sheet is fed to a stamping unit 10 wherein the desired outline of the item is stamped from the sheet. Thereafter, the individual stamped items are preshaped and patterned in a preshaping unit 12 to provide unpolished but shaped items having any desired pattern applied thereto.

The unpolished preshaped items, for example, spoons, are then forwarded to a racking and unracking station 14 wherein, at the downstream end thereof, the items are mounted on empty racks which are suspended from an overhead drive track 16. The successive racks are conveyed by the drive track 16 to an electropolishing tank 18 wherein the items are subjected to electropolishing.

The electropolished items pass on the racks through a rinsing unit 20 before entering the racking and unracking station 14. The rinsed items are removed from the racks at the upstream portion of the station 14 and the empty racks are refilled with further items in the downstream portion of the station 14.

The removed items are forwarded to a passivation tank 22 wherein the electropolished surface is passivated with nitric acid solution. After passivation, the items are washed first in cold wash unit 24 and finally in a hot wash unit 26. The items are removed from the hot wash unit 26 and dry rapidly. The dry items are forwarded for packaging.

The construction of the electropolishing tank 18 and the details of the racking system are illustrated in detail in FIGS. 2 to 5. A plurality of racks 28 is suspended in longitudinally spaced relation in generally planar alignment on the overhead drive track 16 and each rack 28 supports a plurality of items therein. The drive track passes over guide pulleys 30 adjacent the tank 18 to permit entry of the racks 28 into the electrolyte in the tank 18 at one end of the tank, transportation of the racks 28 through the tank 18 from the one end to the other and removal of the racks 28 from the electrolyte at the other end.

The electrolyte tank 18 is constructed of any desired electrolyte-resistant material, such as, a polyethylene liner mounted in an outer steel tank. An outer cooling jacket 32 and heaters (not shown) may be provided, to control the electrolyte bath temperature in the desired range.

Electrical power is applied to the tank 18 from a D.C. rectifier, not shown, through power feed lines 34 and 36. The power lines 34 are connected to anode bars 38 which extend the length of the tank in parallel horizontally-spaced relationship. The anode bars 38 preferably are constructed of copper and have a circular cross-section to allow the racks 28 to be transported thereon when passing through the tank 18, as described in more detail below.

The power lines 36 are connected to cathodic bars 40 which extend the length of the tank 18 in parallel horizontally-spaced relationship. From each of the cathodic bars 40 is suspended a plurality of elongate cathode plates 42 which extend into the electrolyte 44 to a location below the maximum depth of the racks 28, as seen in FIG. 4.

It will be seen from FIG. 4 that a considerable dead space is provided below the racks 28 and the cathode plates 42 to accommodate sludge deposited from the bath during the electropolishing operation.

The cathode plates 42 and the cathodic bars 40 are preferably constructed of lead and joined to each other through copper or other conductive strips 46. The plurality of cathode plates 42 suspended from each cathodic bar 40 may be replaced by a single lead sheet extending the length of the bath 18 and suspended from each bar 40.

Each cathodic bar 40 is rectangular in shape for ease of electrical and mechanical connection to the plates 42, although other shapes may be used.

One anodic bar 38 and one cathodic bar 40 are mounted in vertical parallel alignment in one block 48 of insulating material while the other anodic bar 38 and the other cathodic bar 40 are mounted in a second insulating block 48. The insulating blocks 48 are supported at either end and optionally at spaced locations between the ends of the tank 18.

Figure 5:
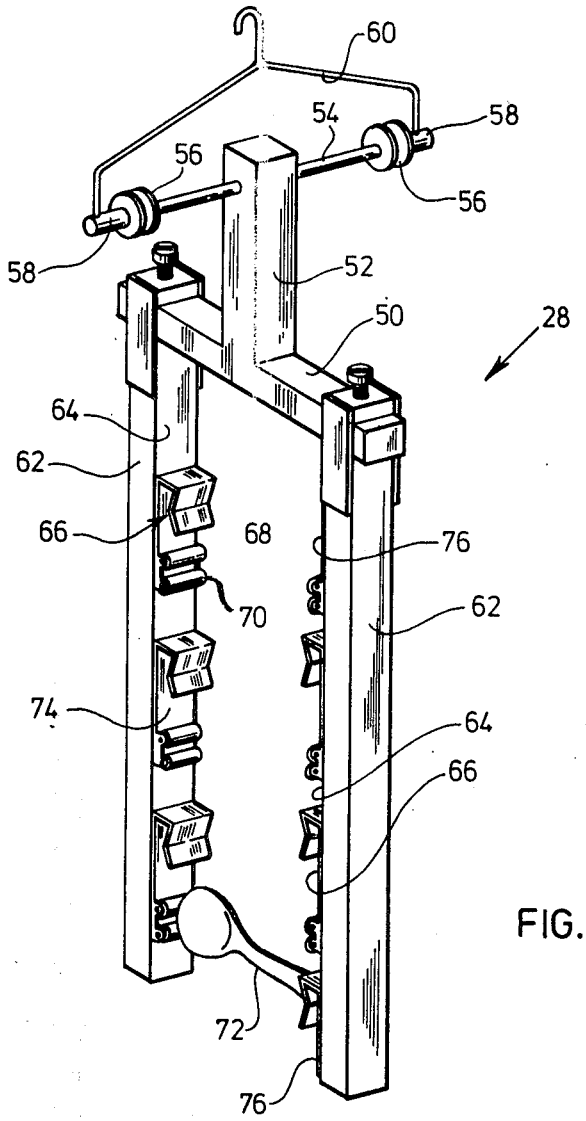
FIG. 5 is a perspective view of a rack for holding cutlery items during electropolishing in the electropolishing tank.

The construction of the rack 28 is shown in detail in FIG. 5. Each rack 28 consists of a cross-arm member 50 extending generally in the direction of motion of the rack and having an upward projection 52 secured thereto at the approximate mid-point of its length.

Figure 3:
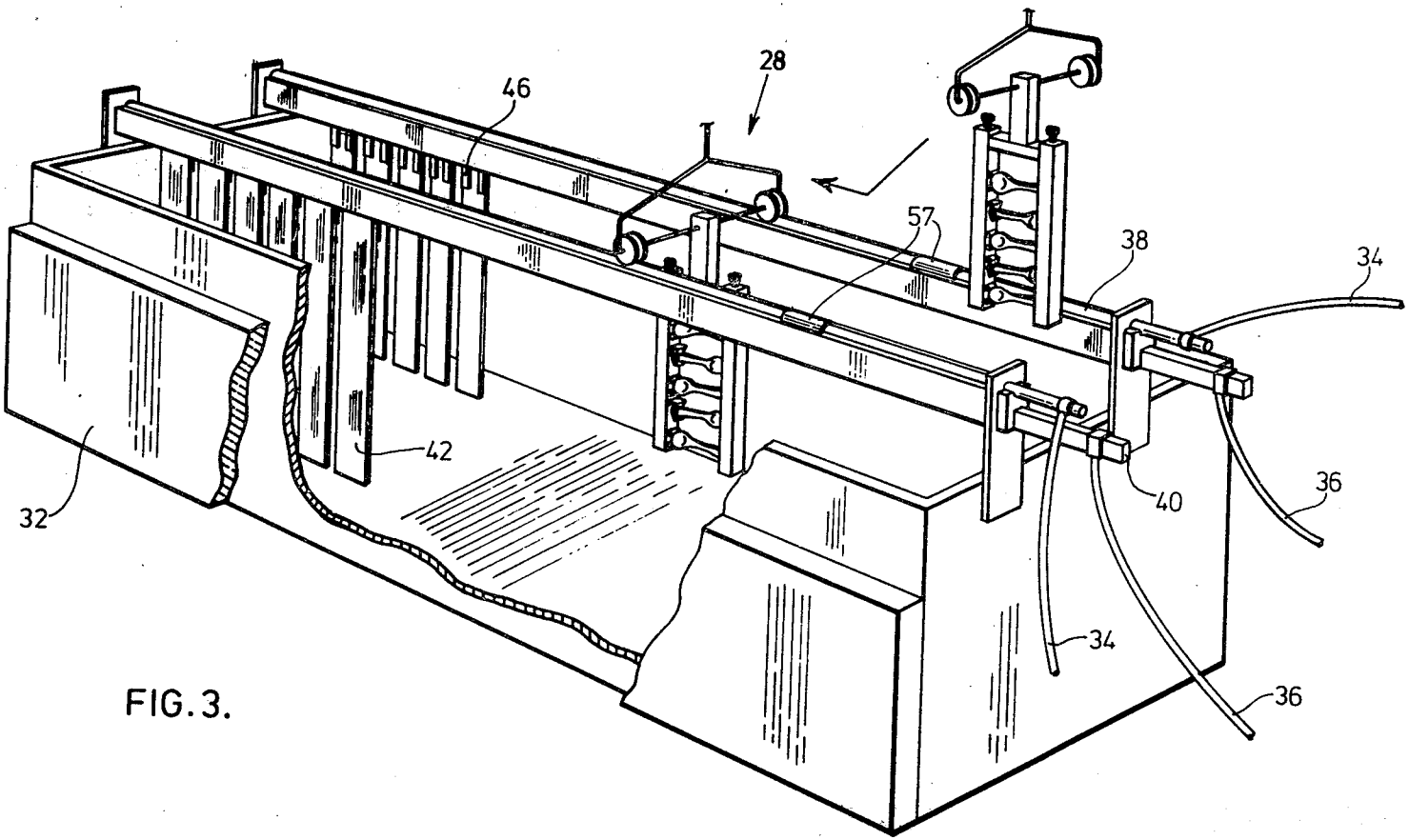
FIG. 3 is a detailed perspective view, with parts cut away, illustrating the electropolishing tank.

A circular rod 54 passes through the projection 52 at its upper end in a direction perpendicular to the direction of extension of the cross-arm and has rollers 56 mounted adjacent each end for supporting the racks 28 on the anodic bars 38, as seen in FIGS. 3 and 4, and transporting the same through the tank 18 by rolling on the bars 38.

To prevent sparking between the electrically-conducting anode bars 38 and the rollers 56 when the racks 28 approach the bars 38 during entry to the tank, the landing area of the anode bars 38 is provided with insulating covering 57, as seen in FIG. 3.

Insulating sleeves 58 are provided at each end of the rod 54 and the sleeves 58 support a suspending hook and arms arrangement 60 which suspends the rack 28 from the track 16.

Slidably connected to each half of the cross-arm member 50 is a depending spine member 62 of square or rectangular cross-section. Mounted to the facing surfaces 64 of the spine members 62 are a plurality of item support members 66. The slidable relationship between the spines 62 and the cross-arm member 50 allows the accommodation of cutlery items of differing lengths on the racks 28.

The support members 66 on one spine member 62 alternate vertically between an electrically-conducting sprung member 68 and an electrically-insulating double roller member 70. The illustrated shape of the members 68 and 70 aids in the racking and deracking of items. The support members 66 on horizontally opposed portions of the surfaces 64 are of the alternate type and cooperate to support a spoon 72 or other cutlery item therebetween, as seen in FIG. 5.

For ease of construction, the sprung member 68 and the double roller member 70 may be provided at vertically opposite ends of a flat strip member 74 which is secured to the surface 64. In the illustrated embodiment of FIG. 5, three such strip members 74 are provided on the left-hand spine 62 and two such strip members 74 are provided on the right-hand spine 62 with the sprung member 68 and the double roller member 70 mounted respectively at the top and bottom of the right-hand spine 62 are connected to separate flat strip members 76.

It is possible to provide three strip members 74 on the right-hand spine 62 by mounting the same upside down with respect to those mounted on the left-hand spine 62.

The rack illustrated in FIG. 5 is intended to hold six spoons, although greater and lesser numbers may be supported by appropriate change in the dimensioning, consistent with the requirement that the hydrostatic pressure on the item being polished is less than about 1.2 psi (85 g/sq.cm).

The cross-arm member 50, the spines 62, the strips 74, the sprung member 68, the projection 52, the rod 54 and the rollers 56 are constructed of electrically-conductive material, usually copper, so that electrical connection is established between the anodic bars 38 and the spoons 72 in the racks 28.

The suspension of the spoons 72 by spring action between the sprung member 68 and the insulating rollers 70 with contact between the spoons 72 and the rollers 70 occurring at only a very small surface area results at worst in only very minor projections which can be easily removed. This is in contrast to depressions which are formed at the contact points when conducting contacts are used at both ends of the spoon, necessitating considerable later hand grinding to the depth of the depressions.

The bowl end of the spoon 72 is illustrated contacting the insulating rollers 70 but the orientation may be reversed. Similarly, the illustrated construction results in the supporting of each vertically successive spoon in the reverse direction. This arrangement is preferred to allow compact packing and even distribution of gaseous product, but may be varied, if desired.

While it is preferred to use copper as the major material of construction owing to its high electrical conductivity, it has been found that copper is attacked to a mild degree by the electrolyte of the bath.

This problem may be overcome by coating the spines 62 with an electrolyte-resistant polymeric material or by using an electrolyte-resistant electrically-conducting metal, such as, titanium, as the material of construction.

To render copper springy for the sprung members 68, it is necessary to cold-work the copper. Cold working of the copper, however, appears to accelerate the corrosion of the copper by the electrolyte, so that sprung members 68 constructed wholly of cold-worked copper have only a limited life before requiring replacement, although very effective during that life.

Figure 6:
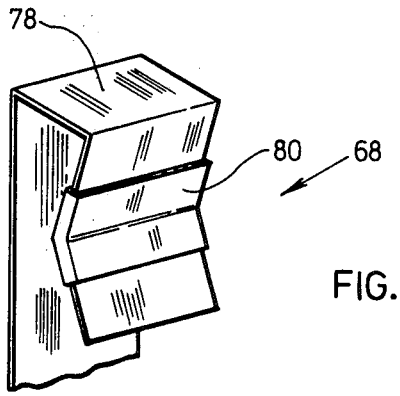
FIG. 6 is a close-up perspective view of an alternative form of supporting clip for use in the rack of FIG. 5.

Replacement of the sprung copper member 68 by one constructed of titanium is not satisfactory. FIG. 6 shows an alternative embodiment of the sprung member 68 comprising a titanium body 78 having an outer sleeve 80 of copper provided on the item-engaging surface of the sprung member 68. This composite arrangement has been found to operate satisfactorily.

Since the copper sleeve 80 is not cold-worked, it is corroded only very slowly. When the sleeve has been consumed, it is a simple matter to replace the same without the necessity for replacing the whole support member 66.

In FIG. 7, there is illustrated an alternative racking arrangement for spoons 72. In this instance, the insulating rollers 70 are replaced by a generally C-shaped contact member 82 constructed of electrically-insulating material, such as, alumina. The C-shape cross-section of the contact member 82 results in contact with a very small surface area of the adjacent end of the spoon 72. As in the case of the embodiment of FIG. 5, the spring action of the electrically-conductive sprung contact 68 serves to ensure that the spoon 72 is gripped between it and the insulating contact 82 in the rack 28.

The electrofinishing procedure outlined above in connection with FIGS. 1 to 7, therefore, requires a minimum of manual operations and is capable of producing a plurality of corrosion-resistant polished stainless steel items at high speed.

EXAMPLES

EXAMPLE 1

Specimens for treatment were made from magnetic stainless steel rods having a diameter of 0.8 cm and a length of 8.5 cm. One end of the rod was machined on a lathe and threads were cut over a length of 3.75 cm. After cleaning the specimen, it was immersed in an Electro-Gleam 55 solution which had been modified to provide a specific gravity of about 1.81 determined at 60° F. (15° C.) and a dissolved iron content of about 1 wt.%. Lead was used as the cathode.

At varying bath temperatures and applied voltage rates of removal of metal from the specimen was determined. While smoothening of the threads was observed under all conditions, only at temperatures above 70° C. was brightening of the surface observed.

Figure 9:
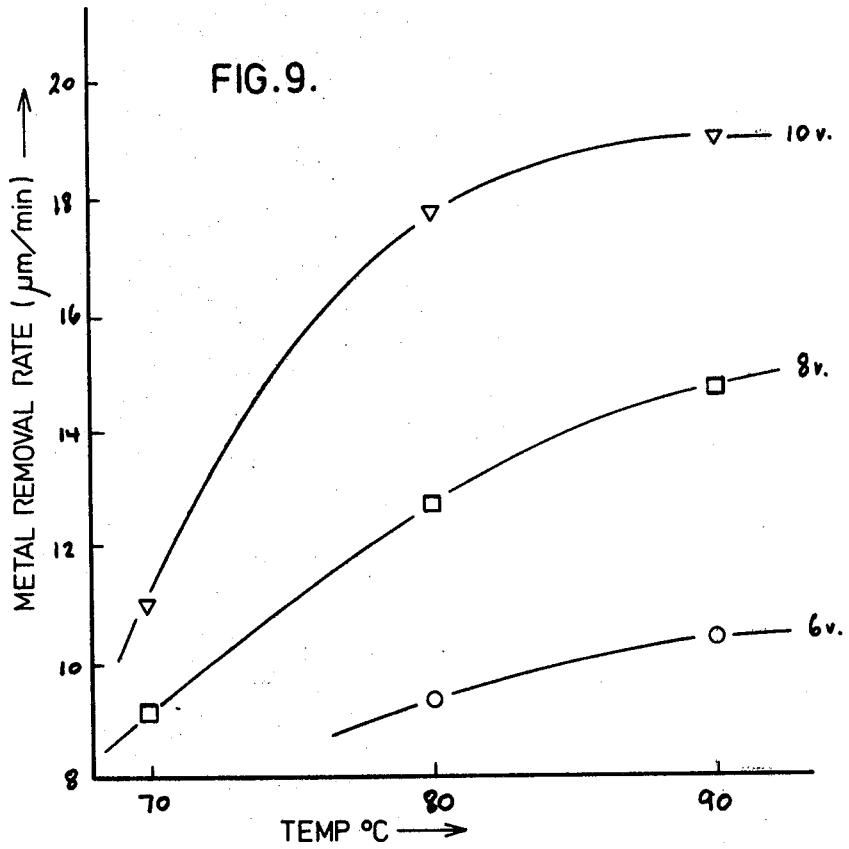
FIGS. 8 and 9 are graphical representations of metal removal rates during electropolishing of magnetic stainless steel.
Figure 8:
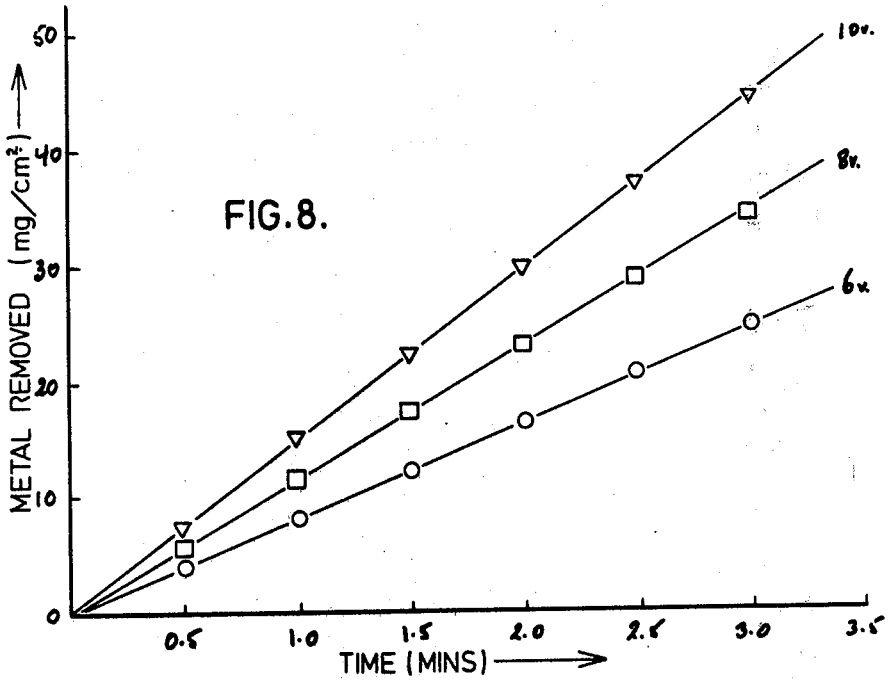

FIGS. 8 and 9 show in graphical form metal removal rates at different voltages and temperatures. As may be seen from those Figures, at the same temperature, the metal removal rate is higher for higher voltages, while at the same voltage, higher temperatures produce higher metal removal rates.

EXAMPLE 2

Several spoons constructed of magnetic stainless steel and several spoons constructed of non-magnetic stainless steel were subjected to electrochemical treatment as the anodes in an electrolyte bath under various conditions. The initial electrolyte bath analyzed as follows:

Orthophosphoric acid 44 wt.%
Sulphuric acid 25 wt.%
Hydroxyacetic acid 13 wt.%
Aryl Sulfonic acids 10 wt.%
Water 8 wt.%

The conditions used and results obtained are set forth in the following Tables I and II:

TABLE I

| Voltage (volts) | Current Density (amps/sq.in) [amps/sq.cm] | Temp. (° C.) | Time (mins) | Iron Content wt.% | Bath S.G. (at 85° C.) | Finish Remarks | Finish Quality |
|---|---|---|---|---|---|---|---|
| | | | MAGNETIC STAINLESS STEEL | | | | |
| 8.5 | 5.48 [0.85] | 92 | 8 | 0.15 | 1.71 | Heavy gas streaking | Unacceptable |
| 8.0 | 3.98 [0.62] | 86 | 8 | 0.96 | 1.73 | Good mirror finish | Acceptable |
| 8.2 | 4.1 [0.64] | 85 | 8 | 2.9 | 1.76 | Good mirror finish | Acceptable |
| 8.3 | 5.5 [0.85] | 83 | 8 | 2.86 | 1.71 | Good mirror finish | Acceptable |
| 8.5 | 5.56 [0.86] | 85 | 8 | 4.3 | 1.71 | Good mirror finish | Acceptable |
| 8.0 | 5.56 [0.86] | 85 | 8 | 4.4 | 1.68 | Severe Grain streaking | Unacceptable |

TABLE II

| Voltage (volts) | Current Density (amps/sq.in) [amps/sq.cm] | Temp. (° C.) | Time (mins) | Iron Content wt.% | Bath S.G. (at 85° C. | Finish Remarks | Finish Quality |
|---|---|---|---|---|---|---|---|
| | | | NON-MAGNETIC STAINLESS STEEL | | | | |
| 7.2 | 4,15 [0.64] | 92 | 8 | 0.08 | 1.71 | Etching, pitting, gas streaking | Unacceptable |
| 8.4 | 4.15 [0.64] | 86 | 8 | 0.92 | 1.73 | Light pitting | Unacceptable |
| 7.0 | 3.0 [0.47] | 85 | 8 | 2.9 | 1.76 | Good mirror finish | Acceptable |
| 8.3 | 4.3 [0.67] | 83 | 8 | 2.86 | 1.71 | Good mirror finish | Acceptable |
| 8.0 | 4.0 [0.62] | 85 | 8 | 4.3 | 1.71 | Good mirror finish | Acceptable |
| 7.2 | 4.0 [0.62] | 85 | 8 | 4.4 | 1.68 | Dull bowl | Unacceptable |

The data presented in the above Tables I and II demonstrate that, within the other variables of voltage, current density, temperature and time, certain interrelated iron content and specific gravity values are required.

For example, in Table I, while a bath specific gravity of 1.71 produces an acceptable mirror finish on magnetic stainless steel at a dissolved iron content of 2.86 and 4.3 wt.%, the finish is unacceptable at an iron content of 0.15 wt.%. Similarly, at a dissolved iron content of 4.3 wt.%, a satisfactory product was obtained at a bath specific gravity of 1.71 while at a marginally higher dissolved iron content of 4.4 wt.%, an unacceptable product was obtained at the lower specific gravity of 1.68.

In Table II, parallel results are obtained for non-magnetic stainless steel but it will also be noted that at 0.92 wt.% dissolved iron and 1.73 specific gravity an unacceptable product is obtained in the case of non-magnetic stainless steel whereas an acceptable product was obtained in the case of magnetic stainless steel, indicating that a higher iron content of the electrolyte bath is required in the case of non-magnetic stainless steel.

EXAMPLE 3

A series of electropolishing tests were carried out on spoons constructed of both magnetic and non-magnetic stainless steels in an electrolyte bath having the same initial composition as set forth in Example 2 under similar conditions of temperature, current density, applied voltage and time. In these tests, the dissolved iron concentration in the bath and the specific gravity of the bath were varied to determined operable ranges of these parameters under the chosen conditions. The current efficiency also was determined. The results are reproduced in the following Table III:

TABLE III

| Iron Concentration wt. % | Magnetic Stainless Steel Specific gravity (at 85° C.) Possible Range | Magnetic Stainless Steel Specific gravity (at 85° C.) Optimum Range | Non-Magnetic Stainless Steel Specific Gravity (at 85° C.) Possible Range | Non-Magnetic Stainless Steel Specific Gravity (at 85° C.) Optimum Range | Current Efficiency % |
|---|---|---|---|---|---|
| 0 to 0.7 | 1.63 to 1.67 | — | — | — | 48.7 |
| 0.7 to 1.3 | 1.65 to 1.73 | 1.67 to 1.73 | 1.65 to 1.73 | 1.67 to 1.73 | 48.6 |
| 1.3 to 3.1 | 1.66 to 1.76 | 1.71 to 1.76 | 1.66 to 1.76 | 1.71 to 1.76 | 46.5 |
| 3.1 to 4.6 | 1.68 to 1.77 | 1.71 to 1.77 | 1.68 to 1.77 | 1.71 to 1.77 | 48.3 |
| 4.6 to 5.6 | 1.73 to 1.78 | 1.73 to 1.78 | 1.73 to 1.78 | 1.73 to 1.78 | 47.9 |

The results of the above Table III show that as the dissolved concentration of iron in the electrolyte bath increases, the minimum specific gravity requirement of the bath increases as does the upper acceptable limit of specific gravity. The values for magnetic and non-magnetic stainless steels parallel each other although non-magnetic stainless steels are difficult to electropolish at the low end of the dissolved iron concentration scale.

The current efficiency of the electropolishing operation remained substantially steady over the tested dissolved iron concentration range.

EXAMPLE 4

Several stainless steel items constructed of both magnetic and non-magnetic stainless steel were hand finished in one test, electropolished in accordance with the first step of the invention in another test and electropolished and passivated using the procedures of this invention in a further test. The corrosion resistance of the samples was tested and the results are reproduced in the following Table IV:

TABLE IV

| Magnetic stainless steel | weight loss in g/cm$^2$* |
|---|---|
| -Mechanically polished | destroyed |
| -Electropolished | 0.4619 |
| -Electropolished and passivated | 0.3203 |
| Non-Magnetic stainless steel | |
| -Mechanically polished | 0.0194 |
| -Electropolished | 0.0150 |
| -Electropolished and passivated | 0.0039 |

*-Corrosion resistance as determined by ASTM Standard No. A279-63

The results of the above Table IV demonstrate that the passivation is necessary to provide high corrosion resistance and that mechanically polished items have poor corrosion resistance as compared with electropolished items.

EXAMPLE 5

Sample spoons constructed of magnetic and non-magnetic stainless steels were subjected to electrochemical treatment in an electrolyte bath containing 1.61 wt.% dissolved iron and having an initial composition as outlined in Example 2 at varying depths in the bath. The results are reproduced in the following Table V:

TABLE V

| Spoon type and depth (inches) [cm] | Electrochemical Conditions: Voltage (volts) | Current Density (amp/sq.in) [amp/sq.cm] | Time (mins) | Temp. ° C. | Specific Gravity (at 85° C.) | Surface Appearance |
|---|---|---|---|---|---|---|
| Magnetic | | | | | | |
| −9 [23] | 7.5 | 4.8 [0.74] | 4 | 80 to 85 | 1.75 | Bright mirror finish |
| −21 [53] | 7.5 | 2.8 [0.43] | 4 | 80 to 85 | 1.75 | Light grain streaking overall and severe on back of bowl |
| Non-Magnetic | | | | | | |
| −9 [23] | 7.5 | 5.0 [0.78] | 8 | 80 to 85 | 1.75 | Bright mirror finish |
| −21 [53] | 7.5 | 3.0 [0.47] | 8 | 80 to 85 | 1.75 | Comparatively dull back of bowl |

The results in Table V show that immersing the item to differing depths in the bath varies the finish appearance and indeed produces unacceptable results at high depths. On the basis of these results it was determined that the electropolishing operation should be effected at less than a hydrostatic pressure of 1.2 psi (85 g/sq.cm), corresponding to about 18 inches (46 cm) depth in the bath in which these experiments were effected.

EXAMPLE 6

An electropolishing plant in accordance with FIGS. 1 to 5 was operated on a pilot plant scale and on a continuous basis over a 4 month period to effect electropolishing of magnetic stainless steel spoons. The operating conditions of the electropolishing operation within the pilot plant are reproduced in the following Table VI:

TABLE VI

| | |
|---|---|
| Applied Voltage | 8 to 9 volts |
| Applied Current | 1450 to 1500 amps |
| Current Density | 3.0 to 3.1 amp/sq.in (0.5 amp/sq.cm) |
| Numbers of racks in electrolyte bath at any one time | 11 racks each of 6 spoons |
| Bath Temperature | 85° C. |
| Bath Specific Gravity | 1.75 |
| Dissolved iron concentration over period | increasing up to 7.5 Wt. % |
| Time cycle of individual racks in bath | 4 mins. |

During this period, a consistent mirror finish was obtained on the spoons and sludging of insoluble salts from the bath was observed.

The electropolished spoons mounted on racks of 12 were passivated by immersion in a tank of 25 vol.% nitric acid at about 65° C. for about 30 minutes. After washing and drying, spoons were obtained having a mirror-like corrosion-resistant finish were obtained.

EXAMPLE 7

Strips of titanium measuring ¾ inch (1.9 cm) wide and 0.035 inch (0.09 cm) thick were shaped into an electrode as shown in FIG. 5 and the electropolishing of spoons constructed of both magnetic and non-magnetic stainless steel was effected under the conditions set forth in the following Table VII:

TABLE VII

| | |
|---|---|
| Applied voltage | 7 to 8 volts |
| Applied current | 230 to 250 amps/rack of 6 spoons |
| Bath temperature | 85° C. |
| Bath specific gravity | 1.78 |
| Dissolved iron concentration | 1.6 wt. % |
| Treatment time | 6 to 8 mins. |

The titanium electrode was found to result in heavy "burning" of the spoons at the points of contact and was itself burned whereas parallel tests carried out using an electrode formed wholly of copper produced no mark at all on the spoon or electrode.

Several titanium electrodes were constructed as described above except that a sleeve of thin copper strip having a thickness of about 0.05 inches (0.13 cms) was provided over the spoon-engaging area of the electrode, as shown in FIG. 6. On using the composite electrodes, the result obtained as comparable to that using copper alone with respect to discoloration.

SUMMARY

The present invention, therefore, is directed to a unique method of electropolishing stainless steel items, especially cutlery items. Modifications are possible within the scope of the invention.

What we claim is:

1. A rack for mounting a plurality of stainless steel items in generally parallel horizontal alignment for electrochemical polishing in an electrolyte, comprising first and second upright parallel electrically-conductive members suspended from a common electrically-conductive cross-arm member, and a plurality of pairs of cooperating supporting means mounted to said upright members for supporting one of said stainless steel items between each said pair in generally horizontal alignment, one member of each of said supporting means pairs being an electrically-conductive biasing means mounted in electrical connection to one of said upright members and the other member of each of said supporting means pairs being an electrically-insulating means mounted to the other of said upright members and constructed to contact only a small portion of the item engaging the same.

2. The rack of claim 1 wherein said upright members are movable towards and away from each other along said cross-bar member to accommodate differing lengths of stainless steel item.

3. The rack of claim 1 wherein said biasing means comprises a sprung copper clip.

4. The rack of claim 1 wherein said biasing means comprises a sprung clip formed of titanium having a copper sleeve over at least the stainless steel item engaging portions thereof.

5. The rack of claim 1 wherein said electrically-insulating means comprises a pair of juxtaposed rollers formed of electrically-insulating material.

6. The rack of claim 1 wherein said electrically-insulating means comprises a generally C-shaped member constructed of electrically-insulating material.

7. The rack of claim 1 wherein said cross-bar member and each of said upright members has a generally rectangular cross-section and at least a majority of the one and other member of each adjacent pair mounted to each upright member is constituted by an integral member mounted to said upright member and having the one member formed at one vertical end thereof and the other member formed at the other vertical end thereof.

8. The rack of claim 1 including an electrically-conducting protrusion extending upwardly from the approximate midpoint of the length of the cross-bar member, an electrically-conducting rod extending through the protrusion at its upper end in a direction transverse to the plane of the upright members, electrically-conducting rollers located one at each end of said rod and adapted to engage and be transported on rod-like anode-current carrying means, and hanger and frame means joined to and electrically insulated from said rod for supporting said rack means from above.

* * * * *